United States Patent [19]

Iwata et al.

[11] 4,388,362

[45] Jun. 14, 1983

[54] RELEASED HEAT-SENSITIVE RECORDING PAPER

[75] Inventors: Susumu Iwata, Shizuoka; Keiichi Maruta; Yukihiro Yuyama, both of Numazu, all of Japan

[73] Assignee: Ricoh Co., Ltd., Tokyo, Japan

[21] Appl. No.: 309,661

[22] Filed: Oct. 8, 1981

[30] Foreign Application Priority Data

Oct. 17, 1980 [JP] Japan ..... 55-144268

[51] Int. Cl.[3] ..... B41M 5/18

[52] U.S. Cl. ..... 428/211; 282/27.5; 427/150; 427/151; 427/152; 428/206; 428/207; 428/215; 428/216; 428/320.4; 428/320.8; 428/327; 428/328; 428/329; 428/330; 428/331; 428/342; 428/488; 428/537; 428/913; 430/200

[58] Field of Search ..... 282/27.5; 427/150, 151, 427/152; 428/320.8, 488, 913, 914, 195, 206, 207, 211–213, 215, 216, 218, 320.4, 320.6, 323, 327–332, 334–336, 339, 341, 342, 537

[56] References Cited

U.S. PATENT DOCUMENTS 4,114,926 9/1978 Habib et al. ..... 282/27.5

*Primary Examiner*—Bruce H. Hess

*Attorney, Agent, or Firm*—Flynn, Thiel, Boutell & Tanis

[57] ABSTRACT

A releasable heat-sensitive recording paper is disclosed wherein a heat-sensitive color forming layer and a protective layer are laminated in succession on the surface of a substrate, said color forming layer consisting essentially of a leuco dye and an acidic substance, said protective layer consisting essentially of a water soluble resin, and further a required pattern is printed on this protective layer with an ultraviolet setting type printing ink, while a pressure-sensitive adhesive layer is formed on the back of the substrate and the thus formed layer is covered with a releasable paper.

10 Claims, 1 Drawing Figure

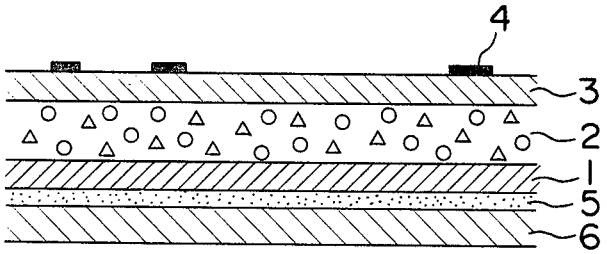
4
3
2
1
5
6

RELEASED HEAT-SENSITIVE RECORDING PAPER

BACKGROUND OF THE INVENTION (a) Field of the Invention

This invention relates to a releasable heat-sensitive recording paper and more particularly to a releasable heat-sensitive recording paper usable with effect especially as a label wherein a heat-sensitive color forming layer and a protective layer are laminated on a substrate, a required pattern is printed on this protective layer with an ultraviolet setting-type printing ink, a pressure-sensitive adhesive layer is formed on the back of the substrate and a releasable paper is provided so as to cover said adhesive layer.

(b) Description of the Prior Art

Labels have hitherto been used everywhere, and many labels have been employed in shops especially on articles which bear labels indicating necessary values such as weights, prices, and the like. These labels have usually been prepared by print processes or ribbon processes (such as stamping press and the like). However, such processes, where an oily or water-based printing ink is used, which ink is inferior in drying ability, involve defects such that much time is consumed for drying and blocking is liable to occur. In addition, ribbon processes are disadvantageous in that much ribbon material is unavoidably wasted and consequently the production cost is increased.

Various attempts have been proposed to prepare labels by using releasable heat-sensitive recording papers. Heat recording processes using releasable heat-sensitive recording papers (for instance, the printing process using a thermal head printer) are surely advantageous in that maintenance is almost dispensed with, the apparatus can be made compact and further the printer itself is not expensive. However, it is to be noted that the releasable heat-sensitive recording papers which have been devised and proposed up to now are each prepared by forming a heat-sensitive color forming layer on a substrate and further printing a required pattern on said heat-sensitive color forming layer, while forming a pressure-sensitive adhesive layer (tacky layer) on the back of the substrate and covering it with a releasable paper, and are arranged so that the area other than said printed area is first allowed to form color and then the releasable paper is removed from the adhesive layer so that the recording paper may be put on the object to be labeled.

It is well known in this art that the heat-sensitive color forming layer of this releasable heat-sensitive recording paper comprises a dispersion of a colorless or pale leuco dye having a lactone, lactam or spiropiran ring and an acidic substance (for instance, such as an organic acid, phenolic substance or the like) in a binder, which can exhibit a more clear-cut color tone than other heat-sensitive color forming materials and further can achieve the desirable effect that it is free from fog.

Nevertheless, the fact is that labels prepared by using conventional releasable heat-sensitive recording paper are not recognized to have practical value. The reason is that such labels are very often used in the market in such a manner that they are stuck to plastic sheets (or bags made of plastics) and said label-bearing bags are piled up. The color image formed on the label fades away by the action of a plasticizer, for instance, such as dioctyl adipate, dioctyl phthalate or the like, incorporated in the plastic sheet put directly on the label. The phenomenon that this colored image fades away by the action of a plasticizer has not yet been explained. However, it is conjectured that said phenomenon is caused because the colored dye is transformed to the original leuco dye by a certain action exerted thereon from the outside (for instance, it comes in contact with fingers) or by the action of a plasticizer. In this connection, it is noted that the influence to be exerted by the plasticizer incorporated in the label-bearing plastic sheet is faint to a negligible extent because said influence is prevented by the adhesive layer of the label.

In the conventional thermal recording papers, furthermore, the above-mentioned blocking problem remains unsolved because when a required pattern is printed, with a water or oily printing ink, on the area other than the colored image area, it is feared that color formation will be caused in the background because the heat-sensitive color forming layer is heated in order to dry said printing ink rapidly.

SUMMARY OF THE INVENTION

A primary object of this invention is to provide a releasable heat-sensitive recording paper which is capable of eliminating the above mentioned drawbacks. Another object of this invention is to provide a releasable heat-sensitive recording paper which does not require complicated manufacturing processes and moreover insures a clear-cut colored image for a long period of time.

In other words, the releasable heat-sensitive recording paper according to this invention is characterized in that a heat-sensitive color forming layer consisting essentially of a colorless or pale leuco dye and an acidic substance which functions to allow said leuco dye to become colored upon heating and a protective layer consisting essentially of a water soluble resin are laminated in succession on a substrate, and further a required pattern is printed on this protective layer with an ultraviolet setting type printing ink, while a pressure-sensitive adhesive layer is formed on the back of the substrate and covered with a releasable paper.

BRIEF DESCRIPTION OF THE DRAWING

The drawing is a cross-sectional view of the recording paper according to this invention, wherein numeral 1 denotes a substrate, 2 denotes a heat-sensitive color forming layer, 3 denotes a protective layer, 4 denotes a required pattern printed with an ultraviolet setting type printing ink, 5 denotes a pressure-sensitive adhesive layer (pressure-sensitive tacky layer), and 6 denotes a releasable paper. In this connection, it is to be noted that symbols  and Δ appearing in the heat-sensitive color forming layer 2 denote the leuco dye and the acidic substance respectively.

DETAILED DESCRIPTION OF THE PREFERRED EMBODIMENTS OF THE INVENTION

The recording paper according to this invention will be explained in more detail hereinafter with reference to the accompanying drawing.

The substrate 1 of the recording paper according to this invention is preferably made from common paper (for instance, paper of high quality or paper of medium quality), and a synthetic paper may be used therefor. On the surface of this substrate 1 there is formed the heat-sensitive color forming layer 2 which consists essentially of (a) a colorless or pale leuco dye, (b) an acidic substance which functions to allow said leuco dye to become colored upon heating and (c) a binder (binder resin).

Typical leuco dyes suitably used herein may be enumerated as follows:

($a_1$) Triphenylmethane dyes having the following general formula:

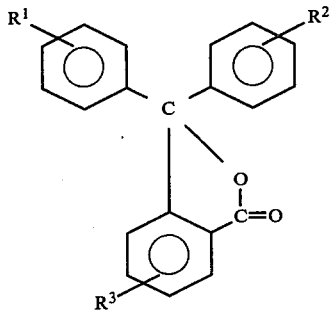

(wherein $R^1$, $R^2$ and $R^3$ are each a hydrogen atom, a hydroxyl group, a halogen, an alkyl group, a nitro group, an amino group, a dialkylamino group, a monoalkylamino group or an aryl group.)

Some of said dyes may be enumerated as follows:

3,3-bis(p-dimethylaminophenyl)phthalide,
3,3-bis(p-dimethylaminophenyl)-6-dimethylaminophthalide (another name: Crystal Violet Lactone),
3,3-bis(p-dimethylaminophenyl)-6-diethylaminophthalide,
3,3-bis(p-dimethylaminophenyl)-6-chlorophthalide, and
3,3-bis(p-dibutylaminophenyl)phthalide, ($a_2$) Fluoran dyes having the following general formula:

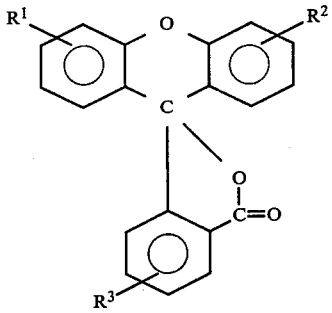

wherein $R^1$, $R^2$ and $R^3$ are the same as defined in ($a_1$))

Some of said dyes may be enumerated as follows:

3-cyclohexylamino-6-chlorofluoran,
3-(N,N-diethylamino)-5-methyl-7-(N,N-dibenzylamino)fluoran,
3-dimethylamino-5,7-dimethylfluoran,
3-diethylamino-7-methylfluoran, and
3-diethylamino-7,8-dibenzofluoran, and ($a_3$) Fluoran dyes:

Some of said dyes may be enumerated as follows:

3-diethylamino-6-methyl-7-chlorofluoran,
3-pyrrolidino-6-methyl-7-anilinofluoran,
2-{N-(3'-trifluoromethylphenyl)amino}-6-diethylaminofluoran, and
2-{3,6-bis(diethylamino)-9-(o-chloroanilino}xanthyl benzoic acid lactam These dyes ($a_1$), ($a_2$) and ($a_3$), as described above, are merely enumerated as typical ones from among colorless or pale leuco dyes. Accordingly, it is to be noted that every dye well known in the heat-sensitive recording paper field may be used herein.

Next, typical acidic substances may be enumerated as follows: ($b_1$) Inorganic acids and organic acids including boric acid, oxalic acid, maleic acid, tartaric acid, citric acid, succinic acid, benzoic acid, stearic acid, gallic acid, salicylic acid, p-hydroxy-2-naphthoic acid, o-hydroxybenzoic acid, m-hydroxybenzoic acid, 2-hydroxy-p-toluic acid and the like and ($b_2$) phenol substances including 3,5-xylenol, thymol, p-tert-butylphenol, 4-hydroxyphenoxide, methyl-4-hydroxybenzoate, 4-hydroxyacetophenone, $\alpha$-naphthol, $\beta$-naphthol, catechol, resorcinol, hydroquinone, 4-tert-octylcatechol, 4,4'-sec-butylidenephenol, 2,2-dihydroxydiphenyl, 2,2'-methylenebis(4-methyl-5-tert-butylphenol), 2,2'-bis(4'-hydroxyphenyl)propane, 4,4'-isopropylidenebis(2-tert-butylphenol), 4,4'-sec-butylidenephenol, pyrogallol, phloroglucinol, phloroglucinol carboxylic acid and the like. In this connection, it is to be noted that these acidic substances enumerated above serve only as examples, and every acidic substance well known in the heat sensitive recording paper field may naturally be employed herein.

In addition, as typical binders (bonding agents) there may be enumerated water soluble ones such as polyvinyl alcohol, methoxycellulose, hydroxyethylcellulose, carboxymethylcellulose, polyvinyl pyrrolidone, polyacrylamide, polyacrylic acid, starch, gelatin and the like, or aqueous emulsion type ones such as polystyrene, vinyl chloride-vinyl acetate copolymer, polybutylmethacrylate and the like. In this connection, it is to be noted that in the case of this binder there may be also employed every other binder that is well known in the heat-sensitive recording paper field.

If needed, fine powder of calcium carbonate, magnesium carbonate, alumina, silica, talc, barium sulfate, aluminium stearate, styrene resin, urea-formalin resin or the like (particle diameter: 0.01 to 5.0 $\mu$m) may be added to the heat-sensitive color forming layer in order to enhance the distinctness of the colored image.

A proper quantity of said fine powder (filler) may also be added to the protective layer 3 that is formed on the heat-sensitive color forming layer 2 and comprises a water soluble resin. The binders as enumerated with reference to the heat-sensitive color forming layer 2 are applicable as the water soluble resin used herein.

The pattern 4 to be preformed as occasion demands, for instance, such as the margin of a label, a mark or the like, is printed on this protective layer 3 with an ultraviolet setting type printing ink. In this instance, every conventional ultraviolet setting type printing ink may be used and the formation of patterns 4 may be carried out by not only one-color printing but also by two or more-color printing.

The "ultraviolet setting type printing ink" referred to herein, as can be seen from Japanese Laid Open Patent Application Nos. 124133/1974, 61460/1973 and 62914/1980, consists essentially of a photo-polymerization initiator, a prepolymer, a monomer, a pigment and the like, said pigment being the same as one used in the conventional ink.

The ultraviolet setting type printing ink (UV ink) is normally dried with light whose wavelength is in the range of from 200 to 400 nm. For that purpose, there is normally used a medium- or high-pressure mercury lamp. As the photo-polymerization initiator there is used a compound capable of producing a radical on radiation of light of said wavelength.

The photo-polymerization initiators adapted for practical use include benzoins, acetophenones, ketone/amine mixtures, benzyl-ketals, aryl-diazonium salts and the like. As the concrete examples there can be enumerated benzoin, alkyl ether derivatives of benzoin, trichloroacetophenone, dialkoxy-acetophenone, benzophenone, 4,4-bisdiethylaminobenzophenone, benzyl-dimethylketal and the like.

The prepolymer in the UV ink, which corresponds to the resin in the conventional ink, includes unsaturated polyesters, vinyloxyethylacrylates, urethane-acrylates, epoxy-acrylates, dicyclo-pentadiene acrylates and the like.

The monomer in the UV ink, which corresponds to the solvent in the conventional ink, must be capable of controlling the viscosity of the ink. As the monomers usable herein there can be enumerated, for instance, acrylic acid esters, methacrylic acid esters, aryl compounds, styrene and the like. Of these, acrylates are superior in value in practical use. As such acrylates there can be enumerated ethylene glycol diacrylate, 1,6-hexanediol diacrylate, bisphenol A-diglycidyl ether diacrylate, pentaerythritol triacrylate, dipentaerythritol hexaacrylate and the like.

An assistant such as a deforming agent can be added where desired. Such assistants preferably have a viscosity of 1000 poise or less.

In place of the aforesaid prepolymers and photo-polymerization initiators there may be used derivatives of cinnamic acid, of which may be enumerated for instance polyvinylcinnamate, cinnamic acid esters of ethylene-vinyl alcohol copolymers, cinnamic acid esters of epoxy resins, cinnamic acid esters of polyethers and the like.

The pressure-sensitive adhesive layer 5 is formed on the back surface of the substrate 1. As adhesives for this purpose there may be employed those well known in this art, for instance, such as acrylic adhesives, vinyl acetate adhesives, rubber adhesives and the like. On this pressure-sensitive adhesive layer 5 there is formed for instance a silicone releasable paper 6.

In the practical preparation of the releasable heat-sensitive recording paper according to this invention, first a resin (binder resin) solution having dispersed therein a colorless or pale leuco dye and a resin solution having dispersed or dissolved therein an acidic substance are prepared separately and then these solutions are mixed together to thereby obtain a solution for forming a heat-sensitive color forming layer. The resulting solution is coated on the surface of a substrate 1 by means of a doctor blade, wire bar or the like and dried at a temperature ranging from room temperature to 120° C., preferably at room temperature, to thereby form a heat-sensitive color forming layer 2 for which the quantity of solids adhered is 4.0 to 10.0 g/m$^2$.

The mixing ratio of leuco dye to acidic substance in the heat-sensitive color forming layer 2 is preferably about 1 part by weight of the former relative to 1 to 5 parts by weight of the latter. And, the percentage of the binder resin in the heat-sensitive color forming layer 2 preferably is about 10 to 30% by weight of the total layer, and 40% by weight or less of the total layer when a filler (powder of calcium carbonate or the like) is added as occasion demands.

A water soluble resin solution is coated on this heat-sensitive color forming layer 2 and dried at a temperature ranging from room temperature to 150° C., thereby forming a protective layer 3 whose quantity of solids adhered is 0.5 to 3.0 g/m$^2$. The thickness of the protective layer 3 varies depending on the different kinds of water soluble resins used therein, but must be within the above defined range. When the protective layer 3 is too thin, there is a tendency that the colored image density, as described above, is deteriorated by the action of the plasticizer contained in the plastic sheet put directly on the label, and when the protective layer 3 is too thick, there is a tendency that the heat pen must be heated to higher temperatures and further the recording speed retarded. It is undesirable to form the protective layer 3 with a resin capable of dissolving an organic solvent because the heat-sensitive color forming layer 2 is affected by the dissolved organic solvent.

A required pattern 4 is printed on this water soluble resin layer (protective layer) 3 within an ultraviolet setting type printing ink, and same is exposed to ultraviolet radiation thereby to form a printed pattern (or prerequisite pattern 4). The thickness of the printed pattern 4 is about 0.1 to 5 μm, although it varies depending on the factors such as the color of ink. However, the formation of this printed pattern may be delayed until the last step of the process for manufacturing this recording paper.

Next, a pressure-sensitive adhesive layer 5 and a releasable layer 6 may be formed by coating the back of the substrate 1 with a pressure-sensitive adhesive in the conventional way and then covering it with a releasing paper, or putting a releasable paper on while coating the back of the substrate with a pressure-sensitive adhesive. This step may also be conducted by first applying the pressure-sensitive adhesive onto the releasable paper and then attaching the surface of the resulting adhesive layer onto the back of the substrate 1.

The thus prepared releasable heat-sensitive recording paper is attached to the requisite object through the steps of printing the non-printed area (the area exclusive of the preformed pattern area) by means of a printer housing a thermal head therein and then removing the releasable paper 6.

As is evident from the aforegoing, the recording paper according to this invention can remarkably prevent the color density from being lowered due to the provision of the protective layer (protective film) 3 on the heat-sensitive color forming layer 2. Furthermore, the recording paper according to this invention can prevent the ocurrence of the blocking phenomenon because the printed pattern (preformed pattern) 4 is printed with the ultraviolet setting type printing ink and has been already set on by ultraviolet radiation immediately after printing, and the invention should be profitable in view of mass production.

EXAMPLES

Every part appearing hereinafter is a part by weight.

EXAMPLE 1

The following compositions were each pulverized and dispersed for 24 hours by means of a ball-mill to thereby obtain Dispersion A and Dispersion B. Thereafter, Dispersions A and B were mixed together to thereby obtain a solution for use in the formation of a heat-sensitive color forming layer.

| | |
|---|---|
| (Dispersion A) | |
| Crystal Violet Lactone | 1.5 parts |
| Polyvinyl alcohol (20% aqueous solution) | 5.0 parts |
| Water | 43.5 parts |
| (Dispersion B) | |
| Bisphenol A | 6.0 parts |
| Calcium carbonate | 3.0 parts |
| Amide stearate | 10 parts |
| Polyvinyl alcohol (20% aqueous solution) | 10 parts |
| Water | 30 parts |

The resulting solution was applied on the surface of a high quality paper (weighing about 50 g/m$^2$) and dried at room temperature to thereby form a heat-sensitive color forming layer whose quantity of solids adhered was about 5 g/m$^2$. Then, a water soluble resin solution was obtained by dissolving 5.0 parts of polyvinyl alcohol in 95.0 parts of water. The thus obtained water soluble resin solution was applied onto the heat-sensitive color forming layer and dried at about 50° C. to thereby form a protective film whose quantity of solids adhered was about 2 g/m$^2$. Thus, a heat-sensitive recording paper was obtained. Successively, a pressure-sensitive adhesive layer was formed on the surface of a silicone resin-coated release pasteboard (releasable surface), and the same was applied onto the back of this high quality paper. Thereafter, a pattern was printed on the heat-sensitive color forming layer with an ultraviolet setting type printing ink (FD-SP Red produced by TOYO INK SEIZO K.K.), and immediately subjected to ultraviolet radiation (high-pressure mercury lamp 2000 W) for 1 second to dry the printed ink. Thus, there was prepared a printed pattern-bearing releasable heat-sensitive recording paper.

The non-printed area of the thus prepared recording paper was printed by means of a printer housing a thermal head therein. The same was covered (close together) with a polyvinyl chloride lap film and was left standing under the conditions of 25° C. and 65% RH for 24 hours to show that the initial printing density (developed color density) of 1.12 remained unchanged and no deterioration in density was perceived. There were observed neither color formation nor change in color tone in the heat-sensitive color forming layer beneath the printed area.

For comparison's sake, a releasable heat-sensitive recording paper was prepared in accordance with the same procedure (wherein the step of ultraviolet irradiation was omitted) as mentioned above except that an oily ink was employed in place of the ultraviolet setting type printing ink. However, this recording paper was observed to involve problems in practical use, namely that the oily ink used for printing the required pattern required a long period of time in dry up and caused a blocking phenomenon when dried in a short time.

A comparative recording paper prepared by printing the required pattern directly on the heat-sensitive color forming layer, omitting the provision of the protective film, with the oily ink, was found to be unserviceable for practical use because the heat-sensitive color forming layer corresponding to the printed area generated color after the lapse of several hours and said generated color mixed with the color of the printing ink.

EXAMPLE 2

The following compositions were each pulverized and dispersed for 24 hours by means of a ball-mill to thereby obtain Dispersion C and Dispersion D. Thereafter, Dispersions C and D were mixed together to thereby obtain a solution for use in the formation of a heat-sensitive color forming layer.

| | |
|---|---|
| (Dispersion C) | |
| 3-diethyl-6-methyl-7-anilinofluoran | 1.5 parts |
| Polyvinyl alcohol (20% aqueous solution) | 5.0 parts |
| Water | 43.5 parts |
| (Dispersion D) | |
| Bisphenol A | 6.0 parts |
| Amide stearate | 1.0 part |
| Polyvinyl alcohol (20% aqueous solution) | 10.0 parts |
| Water | 33.0 parts |

The resulting solution was applied on the surface of a high quality paper (weighing about 50 g/m$^2$) and dried at room temperature to thereby form a heat-sensitive color forming layer whose quantity of solids adhered was about 6 g/m$^2$. Then, a solution obtained by pulverizing and dispersing a composition comprising 5.0 parts of carboxyl group modified polyvinyl alcohol, 2.0 parts of calcium carbonate and 93.0 parts of water in a ball-mill for 24 hours was applied onto the resulting heat-sensitive color forming layer and the same was dried at about 70° C. to thereby form a protective film whose quantity of solids adhered was about 3 g/m$^2$. Thereafter, a pattern was printed and a pressure-sensitive adhesive layer and a releasable pasteboard were provided in accordance the same procedure as Example 1, whereby a releasable heat-sensitive recording paper was prepared.

Successively, this recording paper was allowed to form color under the same conditions as Example 1 and the deterioration in developed color density was measured to find that the density at the time of color formation, i.e.; 1.20 was measured to be 1.19 after the lapse of 24 hours, in other words, the density remained almost unchanged.

Furthermore, the same comparative test as described in Example 1 was repeated on this recording paper to confirm that the substantially same tendency as Example 1 was attained in this instance.

What we claim is:

1. A releasable, heat-sensitive, recording paper comprising:

(a) a substrate;

(b) a heat-sensitive, color-forming layer superposed on said substrate, said heat-sensitive, color-forming layer consisting essentially of a binder, a colorless or pale leuco dye and an acidic substance adapted to cause said leuco dye to undergo color formation upon heating of said recording paper;

(c) a protective layer superposed on said heat-sensitive, color-forming layer, said protective layer consisting essentially of a water-soluble resin and having a thickness of from 0.5 to 3.0 g/m$^2$ in terms of the quantity of the solids thereof;

(d) a pattern of ultraviolet-setting printing ink printed on said protective layer;

(e) a pressure-sensitive adhesive layer superposed on said substrate on the opposite side thereof from said heat-sensitive, color-forming layer and said protective layer; and (f) a release paper covering said adhesive layer.

2. A heat-sensitive, recording paper as claimed in claim 1 wherein the thickness of said heat-sensitive, color-forming layer is 4.0 to 10.0 g/m$^2$ in terms of the quantity of the solids thereof.

3. A heat-sensitive, recording paper as claimed in claim 1 wherein the mixing ratio of said leuco dye to said acidic substance in said heat-sensitive, color-forming layer is 1 part by weight of the former relative to 1 to 5 parts by weight of the latter.

4. A recording material as claimed in claim 3, wherein said binder is present in an amount of from 10 to 30 percent by weight relative to the total weight of said heat-sensitive, color-forming layer.

5. A recording paper as claimed in claim 1, wherein said heat-sensitive, color-forming layer contains a filler in the form of particles having diameters in the range of 0.01 to 5 microns.

6. A heat-sensitive, recording paper as claimed in claim 1 wherein said water-soluble resin is one or two or more members selected from the group consisting of polyvinyl alcohol, methoxycellulose, hydroxyethylcellulose, carboxymethylcellulose, polyvinyl pyrrolidone, polyacrylamide, polyacrylic acid, starch and gelatin.

7. A recording paper as claimed in claim 6, wherein said protective layer consists essentially of said water-soluble resin and a filler in the form of particles of a material selected from the group consisting of calcium carbonate, magnesium carbonate, alumina, silica, talc, barium sulfate, aluminum stearate, styrene resin, and urea-formaldehyde resin, and wherein said particles have particle diameters in the range of 0.01 to 5 microns.

8. A heat-sensitive, recording paper as claimed in claim 1 wherein said pattern of said ultraviolet setting printing ink has a thickness of from 0.1 to 5 $\mu$m.

9. A heat-sensitive, recording paper as claimed in claim 1 wherein said pattern is formed of one-color or two or more colors.

10. A recording material as claimed in claim 1, wherein said ultraviolet setting type printing ink consists essentially of a pigment; a photo polymerization initiator capable of producing a radical upon irradiation with light of a wave-length in the range of 200 to 400 nm, said photo polymerization initiator being selected from the group consisting of benzoins, acetophenones, ketone/amine mixtures, benzyl-ketals and aryl-diazonium salts; a prepolymer selected from the group consisting of unsaturated polyesters, vinyloxyethyl-acrylates, urethaneacrylates, epoxy-acrylates and dicyclo-pentadiene acrylates; and a monomer selected from the group consisting of acrylic acid esters, methacrylic acid esters and styrene.

* * * * *